US005493312A

United States Patent [19]

Knebelkamp

[11] Patent Number: 5,493,312

[45] Date of Patent: Feb. 20, 1996

[54] REDUCED CURRENT ANTENNA CIRCUIT

[75] Inventor: Michael Knebelkamp, Freising, Germany

[73] Assignee: Texas Instruments Deutschland GmbH, Freising, Germany

[21] Appl. No.: 438,602

[22] Filed: May 10, 1995

Related U.S. Application Data

[63] Continuation of Ser. No. 143,263, Oct. 26, 1993, abandoned.

[51] Int. Cl.[6] ..... H01Q 1/50

[52] U.S. Cl. ..... 343/860; 343/742; 340/572

[58] Field of Search ..... 343/742, 744, 343/860, 867, 866; 340/505, 572

[56] References Cited

U.S. PATENT DOCUMENTS

| | | | |
|---|---|---|---|
| 2,111,743 | 3/1938 | Blumlein et al. | 343/860 |
| 3,440,633 | 4/1969 | Vinding | 340/572 |
| 4,551,712 | 11/1985 | Fockens | 340/572 |
| 5,012,224 | 4/1991 | Drucker | 340/551 |
| 5,055,835 | 10/1991 | Sutton | 340/572 |
| 5,099,226 | 3/1992 | Andrews | 340/572 |
| 5,241,298 | 8/1993 | Lian et al. | 340/572 |
| 5,257,033 | 10/1993 | Roche | 343/702 |
| 5,317,330 | 5/1994 | Everett et al. | 343/867 |

FOREIGN PATENT DOCUMENTS

| | | |
|---|---|---|
| 0523272 | 1/1993 | European Pat. Off. . |
| 0523271 | 1/1993 | European Pat. Off. . |
| 0365939 | 5/1990 | France . |

*Primary Examiner*—Donald T. Hajec
*Assistant Examiner*—Tan Ho
*Attorney, Agent, or Firm*—Rebecca A. Mapstone; James C. Kesterson; Richard L. Donaldson

[57] ABSTRACT

An alternative resonant circuit configuration reduces the amount of RF current that is switched by the power-stage transistors of a T/R unit and thereby also significantly reduces the reliability risk. A parallel resonant antenna configuration of coils and capacitors reduces the RF current through the output stage push-pull transistor configuration to a small fraction of the RF current experienced by typical series resonant circuits. This circuit offers advantages of low cost, reliable impedance matching while reducing the volume necessary to perform the function.

4 Claims, 1 Drawing Sheet

REDUCED CURRENT ANTENNA CIRCUIT

This application is a Continuation of application Ser. No. 08/143,263 filed Oct. 26, 1993 now abandoned.

FIELD OF THE INVENTION

This invention generally relates to antenna circuits, suitable for high and low power applications, which do not require use of transformers.

BACKGROUND OF THE INVENTION

To remotely charge up a transponder in a RF identification system, the transmit/receive (T/R) unit must transmit a high magnetic field strength. A magnetic field instead of an electric field is used because the energy density is much higher than an in electrical field. The principle at work can be compared to a simple transformer with the T/R unit coil being the primary part and the transponder coil being the secondary part. The magnetic field couples to the transponder from the T/R unit with a large air gap in between. In view of the above description, a magnetic field may be generated with a series combination of a simple coil and generator. However, with this configuration, a high field strength is only generated if many windings are used, because the magnetic field is proportional to the number of windings.

Therefore, in order to generate high currents, resonance is used and a series capacitor can be added to the generator/coil configuration of the T/R unit. In an ideal series resonance circuit, with a high quality factor, the voltage drop at the antenna(coil) and thus the current through the antenna is multiplied by the quality factor, Q. A Q of 100, for example, generates a voltage at the antenna that is 100 times the value applied to the resonance circuit and the current is multiplied by the same value. In this way, high currents yielding high magnetic field strengths are generated.

This magnetic field is oftentimes generated by either a series or parallel resonant circuit in the T/R unit. When an AC voltage with the resonant frequency is applied to the tuned antenna circuit, the resonant circuit behaves as a very low ohmic resistance, i.e. the D.C. resistance of the antenna coil, allowing the coil of the resonant circuit to efficiently transmit the energy applied. At resonance, an ideal series resonant circuit will appear to the output stage to be a short circuit (impedance =0 ohms) which could cause damage to the output stage. Therefore, the driver circuit must have the capability to drive this low impedance. A transformer can be used to adapt the power-stage of the T/R unit to the low impedance of the resonance circuit, to protect the driver circuit and determine the amount of power that is transferred to the resonator circuit via the ratio of windings. If a transformer is not used, the minimum allowed D.C. resistance of the antenna coil must be specified to ensure that the low impedance of the load does not destroy the driver. However, there are also several disadvantages to using a transformer, including high cost and high-volume requirements both of which are undesirable in ever increasingly smaller-size production modules.

A possible configuration of a circuit which eliminates the transformer is shown in FIG. 1. There are many different ways to realize the generation of an AC voltage in the T/R unit and one of the more common methods is through use of a push-pull stage. A push-pull stage can be realized with traditional field effect transistors. These transistors are characterized by a low 'on' resistance and thus exhibit low power loss and an ability to handle large currents. In addition, transistors are very cost effective components. The circuit shown in FIG. 1 consists of a push-pull stage, consisting of a series connected transistor pair depicted as switches S1 and S2, and a series resonant circuit, consisting of an inductor L3 and a capacitor C4.

A significant disadvantage of this circuit is that the transistors S1 and S2, have to switch the complete RF current that is generated when an AC voltage with the resonant frequency is applied to the tuned antenna circuit. In high power applications, i.e. 400 volts peak to peak voltage, the large amounts of RF current generated make the transistors very, very hot and increase the chance for transistor breakdown (exceed the maximum specified current value). This may decrease the reliability of the T/R unit and may reduce the effectiveness of the reader transmission. Moreover, a large heat-sink is oftentimes required to reduce the heating, and heat sinks require great amounts of volume. The heating of the transistors may also reduce the maximum ambient temperature of the entire reader as the maximum temperature of other reader components may be limited.

SUMMARY OF THE INVENTION

An alternative circuit configuration which reduces the amount of RF current that is switched by the power-stage transistors and thereby also significantly reduces the reliability risk is shown in FIG. 2. Instead of the simple series resonant circuit of FIG. 1 connected to the transistors of the power stage, the slightly more complex configuration of coils and capacitors of FIG. 2 reduces the RF current through, for example, S2, to a small fraction of the RF current experienced by the same switch S2 in FIG. 1.

Many advantages are offered by this circuit configuration versus other known circuit configurations in the art. The first advantage offered is the alleviation of the transformer requirement. Transformers are expensive and large in size and therefore not very feasible for small production type modules. Therefore, removing the need for a transformer gains a significant cost saving as well as reduces the amount of space needed to match the power-stage of the transmitter to the antenna circuit.

A second advantage offered is the reduction in the switching current flowing through the output push-pull stage transistors. With the circuit shown in FIG. 2, transistors of the output push-pull stage have to switch only a fraction of the RF current that the output push-pull stage of FIG. 1 would have to switch.

A yet third advantage is the flexibility the circuit configuration in FIG. 2 offers to choose the physical position of the larger, high-volume capacitors C1 and C2. Capacitors C1 and C2 could conceivably be a part of the RF module or a part of the antenna, due to the way in which they are connected to the rest of the circuit in FIG. 2. The voltage drop at the capacitor C3 is nearly a sine wave (the push-pull generates a rectangular voltage) and relatively long cables can be used to connect the second part of the main antenna circuit without the risk of generating electromagnetic interference (for example, by harmonics of a rectangular voltage).

BRIEF DESCRIPTION OF THE DRAWINGS

The invention will be explained in greater detail with reference to an example of an embodiment shown in the drawings, in which.

DETAILED DESCRIPTION OF PREFERRED EMBODIMENTS

Figure 1:
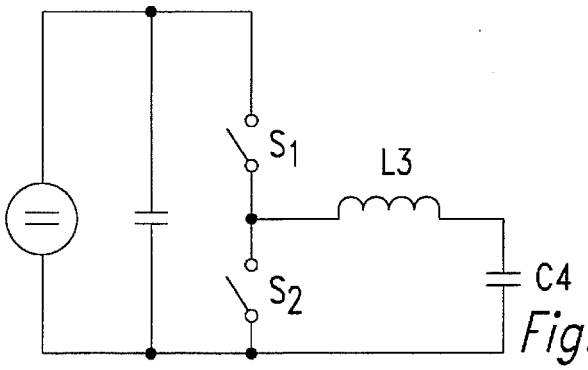
FIG. 1 shows a circuit schematic of an antenna matching circuit which alleviates the need for a transformer.
Figure 2:
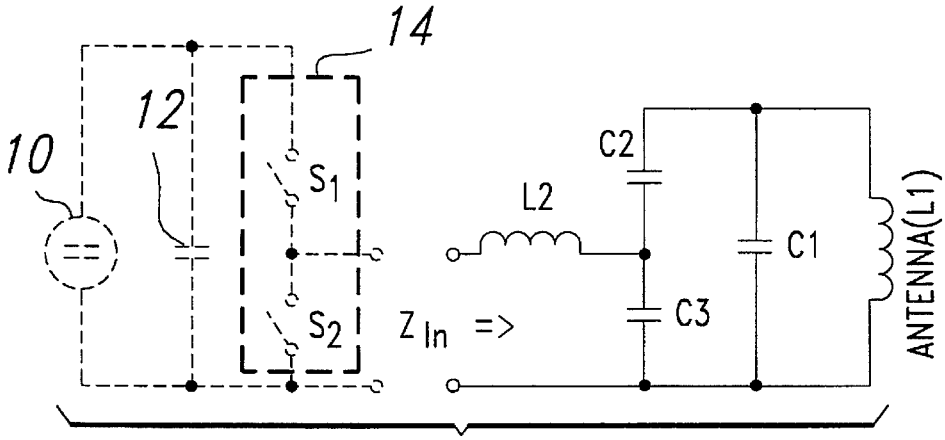
FIG. 2 shows a circuit schematic, according to this invention, of a matching circuit which significantly reduces the amount of current the switching transistors must handle.

The circuit on the left-hand side of FIG. 2 is a schematic of the AC source in the T/R unit realized with a battery 10, a large capacitor 12 and the push-pull stage 14. The circuit on the right hand-side of FIG. 2 is a preferred embodiment of the improved antenna circuit. This antenna circuit allows only a fraction of the RF current which switches through S1 in FIG. 1, to switch through S1 in FIG. 2.

The antenna circuit of FIG. 2 can be divided into two parts. A high-impedance part comprised of capacitors C1, C2 and inductor L1, and a low impedance part comprised of inductor L2 and capacitor C3. The series resonant circuit of inductor L2 and capacitor C3 has a low defined Q that the push-pull stage 14 can drive. Moreover, the low Q series resonant circuit of inductor L2 and capacitor C3 also stimulates the main antenna circuit of L1, C2, and C1. The better the low Q series resonant circuit (L2,C3) is tuned to the resonant frequency of 134.2 KHz, the more the circuit behaves as a low ohmic resistor if connected to an AC voltage with the same resonant frequency. Therefore, the tuning of the low Q part of the antenna circuit (L2,C3) determines the amount of power applied to the main antenna circuit of L1, C2, and C1. Connecting C2, and C1 and L1 to the combination of L2 and C3 as shown in FIG. 2, C1, C2, C3 and L1 constitute a parallel resonant circuit. This circuit can also be tuned to the desired resonant frequency by choosing the appropriate value of capacitors C1 and C2. The impedance of the complete circuit is given by the formula:

$$Z_\epsilon = j\Omega L_2 + \frac{(1-\Omega^2 L_1(C_1+C_2)}{(j\Omega C_3(1-\Omega^2 L_1(C_1+C_2)) + J\Omega C_2(1-\Omega^2 L_1 C_1)}$$

where $\Omega=2\pi f$, and f=frequency.

As previously mentioned, the power stage of the transmitter can be a simple push-pull stage as indicated. One advantage of this antenna circuit is that the transistors of the push-pull stage only have to switch a fraction of the RF current. Switching only a fraction of the RF current greatly reduces heating up the transistors.

Figure 3:
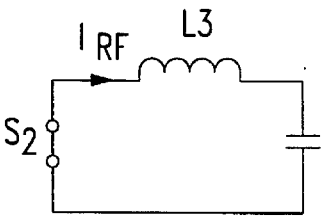
FIG. 3 shows an equivalent circuit of FIG. 1 assuming switch S2 is closed and switch S1 is open.
Figure 4:
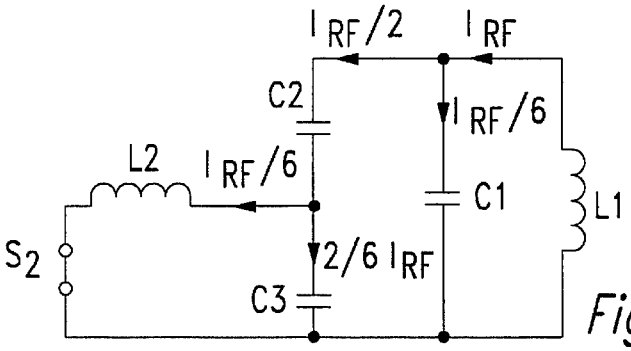
FIG. 4 shows an equivalent circuit of FIG. 2 assuming switch S1 is open and switch S2 is closed.

A comparison of the circuit configurations given in FIG. 1 and FIG. 2 is given in FIGS. 3 and 4. FIGS. 3 and 4 are equivalent circuit configurations of FIGS. 1 and 2, assuming that switch S2 is closed, and switch S1 is open. As can be seen in FIG. 3, switch S2 must switch the entire RF current, as there exists a single path for current to flow in FIG. 3.

However, as shown in FIG. 4, switch S2 must only switch ⅙th (for high power choice of components below) of the entire RF current as there are several current paths in FIG. 4.

The maximum amount of energy that is applied to the main resonant circuit which corresponds to the generated magnetic field strength, can be regulated by the value of L2 or C3. For example, for a low power application, i.e. for a peak antenna voltage of approximately 200 volts, the following components are possible; L1=27.7 μH, L2=2.7 μH, C1=23.5 nF, C2=23.5 nF, and C3= 1.36 uF. For a high power application, i.e. for a peak antenna voltage of approximately 400 volts, C3 should be changed to 880 nF.

A few preferred embodiments have been described in detail hereinabove. It is to be understood that the scope of the invention also comprehends embodiments different from those described, yet within the scope of the claims.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

I claim:

1. An antenna resonant circuit of a T/R unit which reduces the amount of current flowing through the output-power stage of the T/R unit comprising:

an output-power stage of a T/R unit;

a low Q series resonant circuit comprised of a series connected capacitor and an inductor for stimulating a main antenna circuit to oscillate with a resonant frequency;

said main antenna circuit comprised of a parallel combination of a second inductor and a second capacitor connected in series with a third capacitor wherein said third capacitor is connected in series with said series connected capacitor and said parallel combination is connected in parallel with said series combination of said third and said series connected capacitor; and wherein said low Q series resonant circuit is connected in parallel with said output power stage of said T/R unit.

2. The antenna resonant circuit of claim 1, wherein said output power stage comprises a push-pull pair of transistors.

3. The antenna resonant circuit of claim 1, wherein said resonant frequency of said antenna resonant circuit is determined by the values of said second and third capacitors.

4. The antenna resonant circuit of claim 1, wherein the amount of power transferred from the low Q series resonant circuit to the main antenna resonant circuit is determined by the values of the inductor and the capacitor of the low Q series resonant circuit.

* * * * *